US007233253B2

(12) United States Patent
Qualey, III

(10) Patent No.: US 7,233,253 B2
(45) Date of Patent: Jun. 19, 2007

(54) MULTIWAVELENGTH SMOKE DETECTOR USING WHITE LIGHT LED

(75) Inventor: James R. Qualey, III, Rindge, NH (US)

(73) Assignee: SimplexGrinnell LP, Westminster, MA (US)

( * ) Notice: Subject to any disclaimer, the term of this patent is extended or adjusted under 35 U.S.C. 154(b) by 227 days.

(21) Appl. No.: 10/835,930

(22) Filed: Apr. 30, 2004

(65) Prior Publication Data

US 2005/0057365 A1 Mar. 17, 2005

Related U.S. Application Data

(60) Provisional application No. 60/502,339, filed on Sep. 28, 2003.

(51) Int. Cl.
*G08B 17/10* (2006.01)

(52) U.S. Cl. ..... 340/628; 340/629; 340/630

(58) Field of Classification Search ..... 340/628, 340/629, 630; 324/464; 73/25.01; 250/287
See application file for complete search history.

(56) References Cited

U.S. PATENT DOCUMENTS

| | | | | |
|---|---|---|---|---|
| 4,839,527 | A * | 6/1989 | Leitch | 250/573 |
| 4,975,567 | A | 12/1990 | Bishop et al. | 250/211 R |
| 5,568,130 | A | 10/1996 | Dahl | 340/630 |
| 5,576,697 | A | 11/1996 | Nagashima et al. | 340/630 |
| 5,627,515 | A * | 5/1997 | Anderson | 340/517 |
| 5,705,979 | A * | 1/1998 | Fierro et al. | 340/517 |
| 5,896,088 | A * | 4/1999 | Brooks, Jr. | 340/632 |
| 6,326,897 | B2 | 12/2001 | Kadwell et al. | 340/630 |
| 6,791,453 | B1 * | 9/2004 | Andres et al. | 340/286.01 |
| 6,882,272 | B2 * | 4/2005 | Pfefferseder et al. | 340/531 |
| 7,084,401 | B2 | 8/2006 | Bell et al. | 250/341.1 |
| 2005/0057365 | A1 | 3/2005 | Qualey, III | |

FOREIGN PATENT DOCUMENTS

| | | | |
|---|---|---|---|
| EP | 0 877 345 | A2 | 11/1998 |
| GB | 2 319 604 | A | 5/1998 |
| GB | 2 389 176 | A | 12/2003 |
| JP | 04 024797 | A | 1/1992 |
| JP | 04 205400 | A | 7/1992 |
| JP | 2001 116692 | A | 4/2001 |
| WO | 00/07161 | | 2/2000 |

OTHER PUBLICATIONS

Naval Research Laboratory, 4555 Overlook Avenue, SW, Washington, DC 20375-5320, Multiband Photoconductive Detector Based on Layered Semiconductor Quantum Wells.

Milke, et al, AC-02-8-2 Use of Optical Density-Based Measurements as Metrics for Smoke Detectors, The ASHRAE 2002 Winter Meeting, Atlantic City, pp. 699-711.

King, et al, Aerosol Size Distributions Obtained by Inversion of Spectral Optical Depth Measurements, Journal of the Atmospheric Sciences, vol. 35, No. 11, Nov. 1978.

* cited by examiner

*Primary Examiner*—Toan N. Pham

(57) ABSTRACT

A smoke detector includes a smoke detection chamber containing a white light LED and a light detector. The light detector detects light within at least two distinct optical wavelength bands, and generates respective signals indicative of the intensities of the detected light. An analyzer determines, based on the measured light intensities of the different wavelength bands, whether a dangerous smoke/fire condition is present.

22 Claims, 3 Drawing Sheets

MULTIWAVELENGTH SMOKE DETECTOR USING WHITE LIGHT LED

RELATED APPLICATION(S)

This application claims the benefit of U.S. Provisional Application No. 60/502,339, filed Sep. 12, 2003. The entire teachings of the above application(s) are incorporated herein by reference.

BACKGROUND OF THE INVENTION

Conventional photoelectric smoke detectors use a single LED operating at a single narrow wavelength band to illuminate a volume commonly referred to as the smoke chamber. Typically, a single light detector is arranged so that light from the LED is detected only when it is scattered out of its direct path due to the presence of smoke or some other aerosol.

SUMMARY OF THE INVENTION

Due to the use of a single wavelength band, a system such as that described above cannot practically distinguish between smoke due to an unwanted fire and aerosols generated by numerous harmless activities such as cooking and bathing. Such a system is also unable to distinguish between light scattered from smoke (or aerosol) and light originating from the external environment. Therefore, the smoke chamber is typically separated from the external environment by a set of light baffles, commonly referred to as a "labyrinth," which exclude ambient light but admit air and smoke. However, the labyrinth tends to slow the admittance of air and smoke to the smoke chamber, thus increasing the time needed for the smoke detector to react to some types of fires.

An embodiment of the present invention uses a white-light LED as the light source and measures the light scattered and/or transmitted by smoke and other aerosols in two or more distinct wavelength bands. In one embodiment, the scattered and/or transmitted light is measured by a multi-element photodiode detector in which each element is sensitive to a different wavelength band. In another embodiment, the scattered and/or transmitted light is detected by multiple single photodiode detectors, each of which is sensitive to a separate wavelength band.

It is anticipated that the spectrally-resolved scattered and transmitted light intensities measured by this invention will enable it to distinguish between different types of smoke and other aerosols thereby providing a means for substantially reducing the effect of many common nuisance alarm sources. It is also expected that the invention will be inherently less sensitive to external light sources than is typical at present. This will allow the use of light baffles with reduced resistance to smoke entry thus resulting in faster detector response times to some fires.

Milke et al., *Use of Optical Density-Based Measurements as Metrics for Smoke Detectors*, ASHRAE Transactions: Symposia, 699–711 (2002), incorporated herein by reference in its entirety, discusses a "white light source optical density system for smoke detectors." In this article, Milke describes the use of the type of optical density measurement specified in UL 268, "Standard for Smoke Detectors for Fire Protective Signaling Systems," Underwriters Laboratories, Inc. Milke does not attempt to spectrally resolve the white light in order to gain further information regarding the properties of the smoke.

Runciman, PCT publication WO 00/07161, incorporated herein by reference in its entirety, like the present invention proposes utilization of the well-known dependence of scattered light intensity on the ratio between particle size and light wavelength.

However, there are significant differences between Runciman's teachings and the present invention.

First, Runciman employs multiple LEDs (or other light sources such as lasers), each at a separate wavelength.

The present invention, on the other hand, employs a single LED that emits white light, i.e., spectrally broad light, to provide multiple wavelength illumination. The use of a single white light LED as the light source is advantageous in that it reduces parts count, energy consumption (possibly), and the minimum required size of the smoke detector.

Second, Runciman teaches the use of discrete wavelengths with maximum spectral separation, e.g., infrared with blue or violet.

The present invention, on the other hand, uses a continuous spectral distribution over the entire visible range (and potentially beyond, depending on availability of components). This approach can potentially yield much more information than what can be obtained from Runciman's limited number of discrete wavelengths.

Finally, while Runciman teaches the use of either multiple detectors with different spectral sensitivities or a single detector alternately illuminated by different wavelengths, an embodiment of the present invention uses a single, multi-band photodetector to spectrally resolve the scattered white light. Compared to using multiple photodetecting elements, the use of a single photodetector that generates independent output signals for different spectral bands has the advantage of reducing parts count (and cost) as well as the minimum required size of the smoke detector.

Accordingly, in at least one embodiment of the present invention, a smoke detector includes a smoke detection chamber, and within the chamber: a light source having a broad optical spectrum, and a light detector. The light detector detects light within at least two distinct optical wavelength bands within the spectrum of the light source, and generates signals having amplitudes that are responsive to intensities of the detected light.

An analyzer determines, based on the measured light intensities of the different wavelength bands, whether a dangerous smoke/fire condition is present. In at least one embodiment, the analyzer estimates, responsive to the measured light intensities, a size distribution of an aerosol, for example by using an inversion algorithm based on equations for Mie scattering. Alternatively, the analyzer may compare the measured light intensities with previously measured and stored intensity data (i.e., spectral signatures) for at least one aerosol of known composition. The analyzer can also reduce inherent sensitivity to external ambient light.

In one embodiment, the light source emits substantially white light. For example, the light source may be a white light light-emitting diode (LED). In additional embodiments, the light source may emit infrared and/or ultraviolet light in addition to, or instead of visible light.

The light detector can be, for example, a multi-element photodetector, where each element is sensitive to a different wavelength band. Alternatively, the light detector may include multiple photodiodes, where each photodiode is sensitive to a different wavelength band. In yet another embodiment, the light detector is a wideband detector, and a variable color filter is placed before the detector, passing to the light detector at any given time only a selected narrow passband of the spectrum.

The light detector can be placed such that it detects only scattered light, only transmitted light, or a combination.

The analyzer can be located in the smoke alarm, or it can be located in a system controller. In the latter embodiment, a smoke detector also includes communication means for forwarding information about the measured light intensities of the different wavelength bands to the system controller. The smoke detector may forward raw measured light intensity values to the system controller, or alternatively, may partially or fully process (e.g., provide some filtering to) the measured light intensities of the different wavelength bands prior to generating the information to be forwarded.

Another embodiment of the invention is an alarm system which includes a system controller and at least one smoke detector. The smoke detector includes a smoke detection chamber, a light source having a broad optical spectrum, and a light detector. The light detector detects light within at least two distinct optical wavelength bands within said spectrum, and generates signals having amplitudes that are responsive to intensities of the detected light. Both the light source and light detector are contained within the detection chamber. The smoke detector further includes communication means for forwarding information about the measured light intensities of the different wavelength bands to the system controller. The system controller includes an analyzer which determines, based on the measured light intensities of the different wavelength bands, whether a dangerous smoke/fire condition is present.

Another embodiment of the present invention is a fire alarm control panel that includes communication means for receiving, from at least one smoke detector, information about measured light intensities of different wavelength bands; and an analyzer which determines, based on the measured light intensities of the different wavelength bands, whether a dangerous smoke/fire condition is present. At least one of the smoke detectors includes a smoke detection chamber, a light source having a broad optical spectrum, and a light detector which detects light within at least two distinct optical wavelength bands within the spectrum. The light detector generates signals having amplitudes that are responsive to intensities of the detected light. Both the light source and light detector are contained within the detection chamber. The smoke detector further includes transmission means for transmitting the measured light intensity information to the fire alarm control panel.

Another embodiment of the present invention is a method for detecting smoke, including the steps of: in a smoke detection chamber, shining a light source having a broad optical spectrum, and detecting light within at least two distinct optical wavelength bands within said spectrum; generating signals having amplitudes that are responsive to intensities of the detected light; and determining, based on the measured light intensities of the different wavelength bands, whether a dangerous smoke/fire condition is present.

Another embodiment of the present invention is an aerosol detection system that includes a detection chamber, means for allowing an aerosol to pass from an outside, i.e., external to the detection chamber, environment into the detection chamber while blocking most ambient light, a light source having a broad optical spectrum, a light detector and an analyzer. The light detector detects light within at least two distinct optical wavelength bands within said spectrum, the detector generating signals which are responsive to intensities of the detected light, both the light source and light detector being within the detection chamber. The analyzer detects, based on the measured light intensities of the different wavelength bands, whether a particular type of aerosol is present in the detection chamber.

Another embodiment of the present invention is an aerosol identification system that includes a detection chamber, means for allowing an aerosol to pass from an outside environment into the detection chamber while blocking most ambient light, a light source having a broad optical spectrum, a light detector and an analyzer. The light detector detects light within at least two distinct optical wavelength bands within the spectrum, and generates signals that are responsive to intensities of the detected light. Both the light source and light detector are located within the detection chamber. The analyzer identifies, based on the measured light intensities of the different wavelength bands, at least one type of aerosol that is present in the detection chamber.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
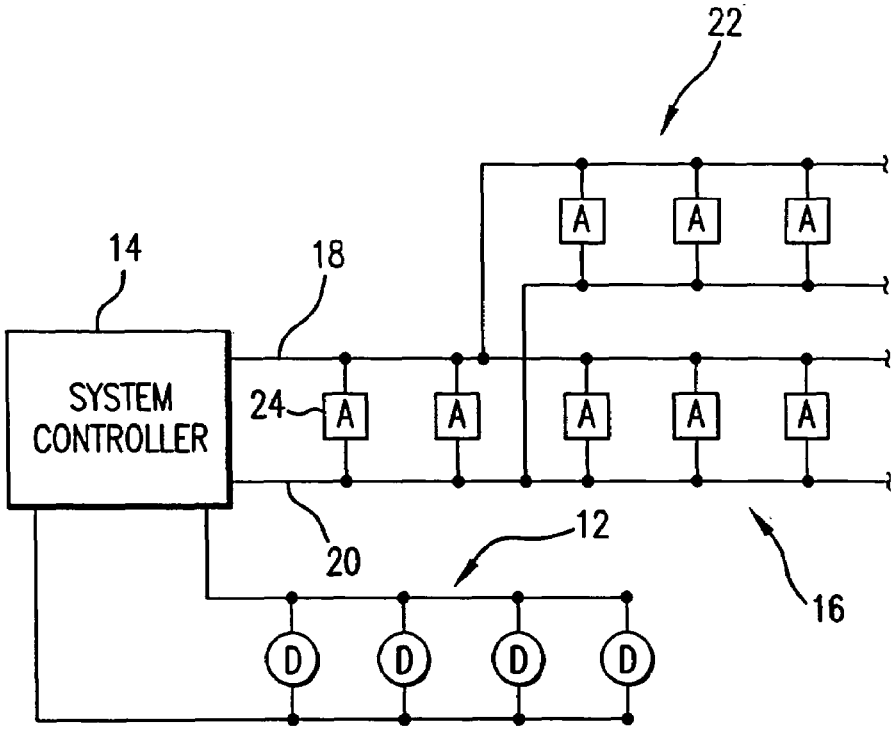
FIG. 1 illustrates an alarm system embodying the present invention.

A system embodying the present invention is illustrated in FIG. 1. As in a conventional alarm system, the system includes one or more detector networks 12 having individual alarm condition detectors D which are monitored by a system controller 14. When an alarm condition is sensed, the system controller 14 signals the alarm to the appropriate devices through at least one network 16 of alarm notification appliances A, which may include, for example, a visual alarm (strobe), an audible alarm (horn), a speaker, or a combination thereof.

As shown, all of the notification appliances are coupled across a pair of power lines 18 and 20 that advantageously also carry communications between the system controller 14 and the notification appliances 24.

Figure 2:
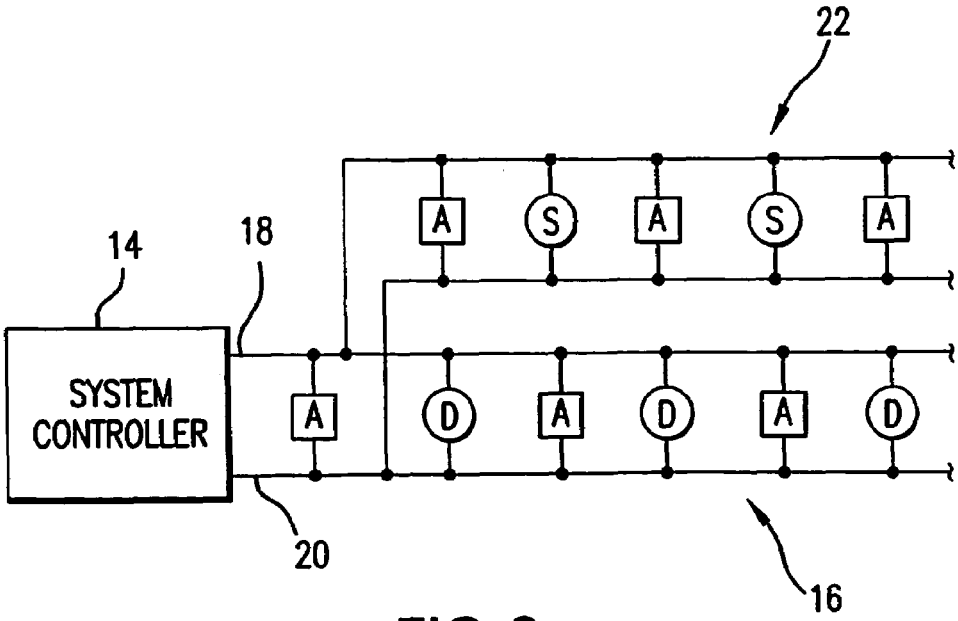
FIG. 2 illustrates an alternative alarm system embodying the present invention.

FIG. 2 illustrates an alternative embodiment of the present invention wherein the detectors D are placed on the same NAC 16 as the notification appliances 24.

Figure 3A:
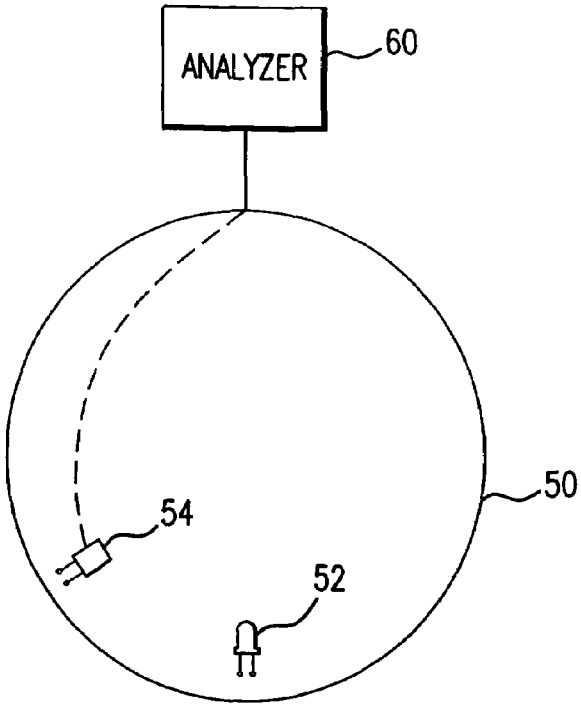
FIGS. 3A–3C are schematic diagrams illustrating various embodiments of the present invention.
Figure 3B:
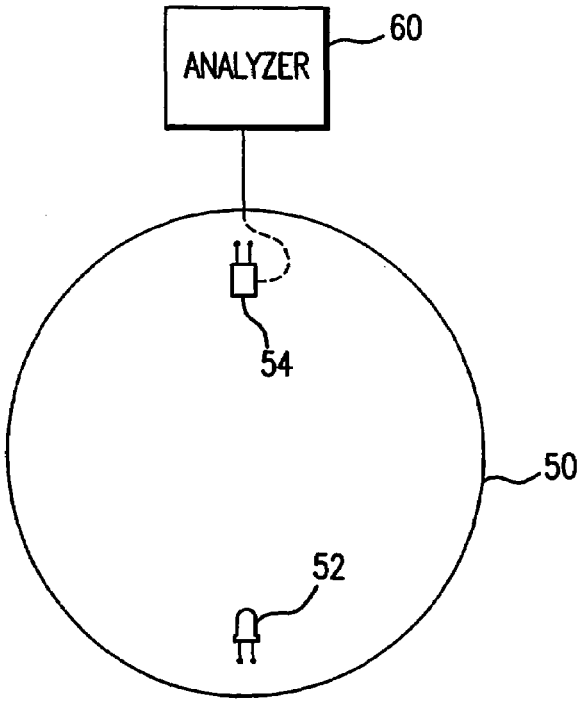
Figure 3C:
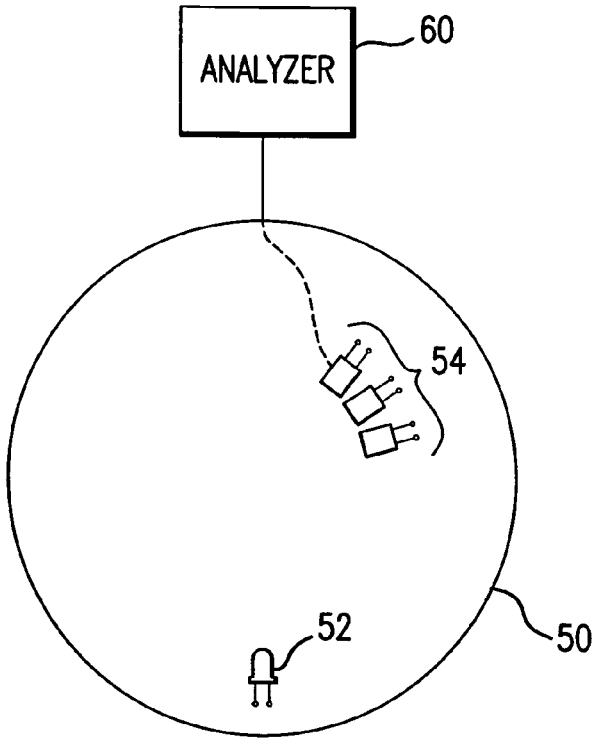
Figure 4:
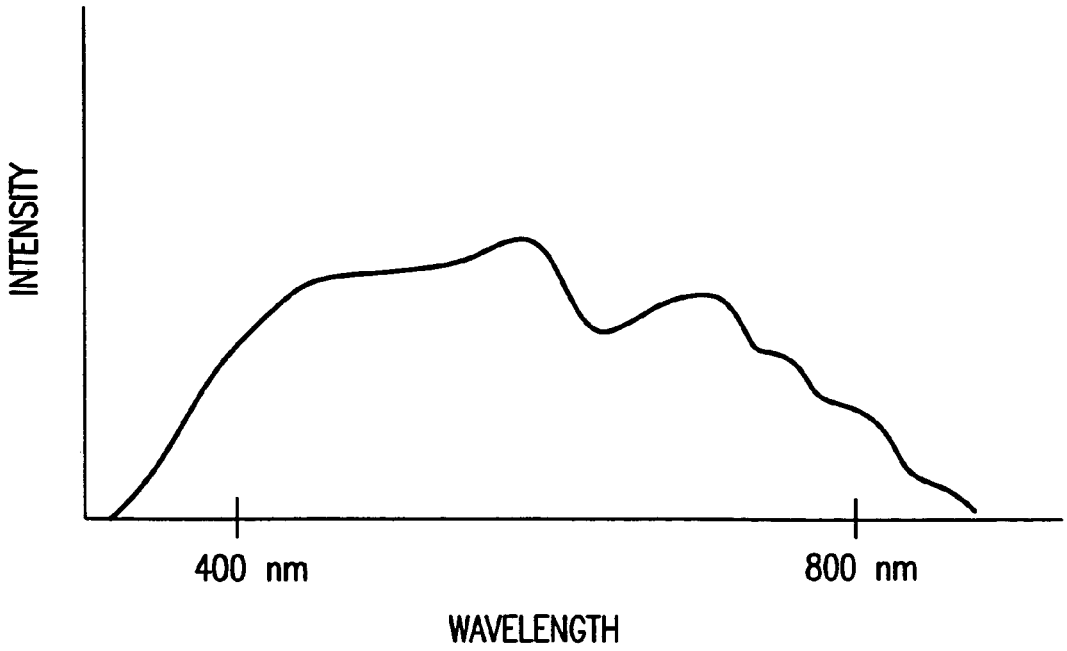
FIG. 4 is a graph, showing, for illustrative purpose, an exemplary spectrum of a white light LED.

FIGS. 3A–3C illustrate schematic diagrams of various embodiments of the present invention. FIG. 3A shows, within a smoke chamber 50, a light source 52 and a multi-element photodetector 54. The light source 52 emits light having a broad, continuous spectrum, such as that shown in FIG. 4, and may be, for example, a white light LED.

Many smoke alarms use a labyrinth (not shown), comprising a series of baffles, to let smoke into the chamber while minimizing the amount of ambient light that enters the chamber.

Smoke entering the smoke chamber 50 scatters the light from the light source 52. The degree to which light is scattered is dependent, among other things, on the wavelength of the light and the size of the smoke particles. Thus, different portions of the broad spectrum are scattered in different amounts.

The photodetector 54 elements detect light from the white light LED 52 within two or more distinct wavelength bands. Alternatively, as shown in FIG. 3C, a photodetector assembly 54 comprising multiple photodetectors, each detecting a different wavelength band, may be employed. Alternatively, a multiband photoconductive detector such as that described in U.S. Pat. No. 4,975,567 may be employed. Alternatively, a charge-coupled device with wavelength-selective filters applied in various combinations to the detection elements may be employed.

Alternatively, a time-varying filter could be employed at the white light source in conjunction with any of the photodetectors discussed above, or even with a wide-band photodetector, or such a filter could be used at a wide-band detector to allow only a narrow band to be detected by the detector at any given time.

FIG. 3B illustrates yet another alternative in which the detector 54 is placed such that it detects transmitted rather than scattered light. As smoke enters the smoke chamber 50, it scatters and/or absorbs the light, and so less of the more scattered and absorbed wavelengths reach the detector 54.

Combinations of detectors may also be deployed and variously placed in order to detect both transmitted and scattered light.

An embodiment of the present invention uses a white-light LED as the light source and measures the light scattered and/or transmitted by smoke and other aerosols in two or more distinct wavelength bands. In one embodiment, the scattered and/or transmitted light is measured by a multi-element photodiode detector in which each element is sensitive to a different wavelength band. In another embodiment, the scattered and/or transmitted light is detected by multiple single photodiode detectors, each of which is sensitive to a separate wavelength band. It is intended that the invention include embodiments which use scattered light only, embodiments which use transmitted light only, and embodiments which include both scattered and transmitted light.

An analyzer 60 then uses the values of the measured light intensities in the different wavelength bands to distinguish signals due to the presence of unwanted fires from those due to causes such as cooking smoke, cigarette smoke, and moisture. Therefore, the incidence of nuisance and false alarms can be reduced as compared to conventional smoke alarms.

In one embodiment, the analyzer 60 comprises an estimator that distinguishes between aerosol types by using light intensities measured at multiple wavelengths to estimate the size distribution function of an aerosol, for example by means of an inversion algorithm based on the equations for Mie scattering.

In another embodiment, the analyzer 60 comprises a comparator unit that distinguishes between types of aerosols by matching the measured intensities of the unknown aerosol in the smoke chamber 50 to the intensities empirically measured on a previous occasion for an aerosol of known composition and stored in a memory.

The use of spectrally-resolved scattered and transmitted light can then be used to distinguish between different types of smoke and nuisance aerosols on the basis of their differing spectroscopic properties.

The invention can also be used, in at least one embodiment, to reduce the inherent sensitivity of the smoke detector to external ambient light. Typical sources of ambient interfering light include incandescent lamps, fluorescent lamps, strobes, and sunlight. Light from these sources will generally have different spectral properties than the white-light LED or other broad spectrum light source 52 of the present invention smoke detector. The multi-wavelength intensity measurements made by this invention therefore enable it to distinguish between light from the white-light LED which is scattered from smoke (or other aerosol) and light originating from an external source.

The decreased inherent sensitivity to external ambient light sources will allow redesign of the light-excluding labyrinth to reduce its resistance to smoke penetration, thus resulting in a smoke detector that responds more quickly to the presence of smoke.

While this invention has been particularly shown and described with references to preferred embodiments thereof, it will be understood by those skilled in the art that various changes in form and details may be made therein without departing from the scope of the invention encompassed by the appended claims.

What is claimed is:

1. A fire alarm control panel, comprising:

communication means for receiving, from at least one smoke detector, information about measured light intensities of different wavelength bands; and an analyzer which determines, based on the measured light intensities of the different wavelength bands, whether a dangerous smoke/fire condition is present;

wherein the at least one smoke detector comprises a smoke detection chamber, a light source having a broad optical spectrum, a light detector which detects light within at least two distinct optical wavelength bands within said spectrum, the detector generating signals having amplitudes which are responsive to intensities of the detected light, both the light source and light detector being within the detection chamber, and transmission means for transmitting the measured light intensity information to the fire alarm control panel.

2. The fire alarm control panel of claim 1, further comprising: an analyzer which determines, based on the measured light intensities of the different wavelength bands, whether a dangerous smoke/fire condition is present.

3. The fire alarm control panel of claim 2, the analyzer comprising an estimator which, responsive to the measured light intensities, estimates a size distribution of an aerosol.

4. The fire alarm control panel of claim 3, the estimator performing its estimation using an inversion algorithm based on equations for Mie scattering.

5. The fire alarm control panel of claim 2, the analyzer comprising a comparator which compares the measured light intensities with previously measured intensity data for at least one aerosol of known composition.

6. The fire alarm control panel of claim 5, the system controller further comprising means for storing the previously measured smoke and aerosol spectral signatures.

7. The fire alarm control panel of claim 1, the smoke detector light detector comprising a photodetector capable of measuring different wavelengths independently of each other.

8. The fire alarm control panel of claim 1, the smoke detector light source being a white light LED.

9. The fire alarm control panel of claim 1, the light source being a broad-spectrum LED.

10. The fire alarm control panel of claim 1, the smoke detector light detector comprising a multi-element photodetector, each element being sensitive to a different wavelength band.

11. The fire alarm control panel of claim 1, the smoke detector light detector comprising a charge-coupled device with wavelength-selective filters applied in various combinations to the detections elements.

12. The fire alarm control panel of claim 1, the smoke detector light detector comprising multiple photodiodes, each photodiode being sensitive to a different wavelength band.

13. The fire alarm control panel of claim 1, the smoke detector light source emitting substantially white light.

14. The fire alarm control panel of claim 1, the smoke detector light source emitting, and at least one of the wavelength bands including at least one of: infrared light; visible light; and ultraviolet light.

15. The fire alarm control panel of claim 1, the light detector detecting at least one of: scattered light; and transmitted light.

16. The fire alarm control panel of claim 1, raw measured light intensity values being forwarded by the smoke detector to the fire alarm control panel.

17. The fire alarm control panel of claim 1, the smoke detector further comprising processing means for processing the measured light intensities of the different wavelength bands prior to generating the information to be forwarded by the smoke detector to the fire alarm control panel.

18. The fire alarm control panel of claim 1, the light source emitting, and at least one of the wavelength bands including, infrared light.

19. The fire alarm control panel of claim 1, the light source emitting, and at least one of the wavelength bands including, ultraviolet light.

20. The fire alarm control panel of claim 1, the light detector detecting only scattered light.

21. The fire alarm control panel of claim 1, the light detector detecting only transmitted light.

22. The fire alarm control panel of claim 1, the light detector detecting both scattered and transmitted light.

* * * * *